US009404671B2

(12) United States Patent
Liang

(10) Patent No.: US 9,404,671 B2
(45) Date of Patent: Aug. 2, 2016

(54) RADIANT HEAT LIFTING DEVICE FOR OUTDOOR FLAME HEATER

(71) Applicant: Hsin-Lien Liang, Taoyuan Hsien (TW)

(72) Inventor: Hsin-Lien Liang, Taoyuan Hsien (TW)

( * ) Notice: Subject to any disclaimer, the term of this patent is extended or adjusted under 35 U.S.C. 154(b) by 640 days.

(21) Appl. No.: 13/860,744

(22) Filed: Apr. 11, 2013

(65) Prior Publication Data

US 2014/0305428 A1 Oct. 16, 2014

(51) Int. Cl.

| | |
|---|---|
| ***F23D 14/14*** | (2006.01) |
| ***F24H 9/00*** | (2006.01) |
| ***F24H 3/00*** | (2006.01) |
| ***F23D 14/12*** | (2006.01) |
| *F24H 3/04* | (2006.01) |

(52) U.S. Cl.

CPC ..... *F24H 9/0073* (2013.01); *F23D 14/125* (2013.01); *F24H 3/006* (2013.01); *F24H 9/0068* (2013.01); *F24H 3/0417* (2013.01)

(58) Field of Classification Search

CPC ..... F24H 9/0073; F24H 3/006; F24H 9/0068; F24H 3/0417; F23D 14/125; F23D 14/12; F23D 2213/00; F23D 2212/00; F24C 15/22; F24C 3/14; F24C 15/06; F24C 15/007; F24C 15/08; F24C 15/12; F24C 3/002; F24C 3/004; F23C 3/002

See application file for complete search history.

(56) References Cited

U.S. PATENT DOCUMENTS

2013/0160756 A1* 6/2013 Yen ..... F24C 3/14 126/275 R

* cited by examiner

*Primary Examiner* — Alfred Basichas

(74) *Attorney, Agent, or Firm* — Rosenberg, Klein & Lee

(57) ABSTRACT

A radiant heat lifting device for outdoor flame heater comprises a glass tube having a section of heat-resistant net tube made of high-temperature resistant material and mounted on an upper opening thereof; a heat-resistant net tube including countless meshes at a periphery thereof, a top outlet sealed and a bottom outlet connected to the upper opening of the glass tube; and a cover being a bowl-shaped arranged on the heat-resistant net tube and including a multitude of circulation holes at a periphery thereof; whereby a flame emitted from the flame outlet along the glass tube up to the top outlet of the heat-resistant net tube by chimney effect to accumulate the heat and produce infrared to increase the radiation thermal of the glass tube; an exhaust in the glass tube outflows from the meshes of the heat-resistant net tube to the circulation holes of the cover and discharges upward.

8 Claims, 7 Drawing Sheets

RADIANT HEAT LIFTING DEVICE FOR OUTDOOR FLAME HEATER

BACKGROUND OF THE INVENTION

1. Field of the Invention

The invention relates to an outdoor flame heater, and more particularly to the radiant heat lifting device having a heat-resistant net tube mounted on a top of a glass tube for accumulating the heat of a flame and producing infrared to increase the radiation thermal of the heater and thus enhance the effect of the outdoor heating.

2. Description of the Related Art

With reference to FIGS. 1A through 1C, US Patent Public No. 2010/0236544 A1 discloses an outdoor flame heater 100 comprising: a bottom housing 10 being composed of a set of four lower support members 11, a set of four panels 12, and other relative members for installing a gas barrel (not shown); a control box 13 releasing a flame to a gas flame outlet 141 of a base 14 on a top of control box 13; a set of four upper support members 15 together with a plurality of protection guards 16 forming a space for installing a glass tube 17; and a reflector 19 mounted onto a damper 191 and the damper 191 mounted on the upper plate 18 being affixed to the upper support members 15.

Base on the prior features disclosed, a flame F in the glass tube 17 is extended upward by the chimney effect, and the thermal energy radiates from the glass tube 17 while an upper outlet 171 of the glass tube 17 discharges an exhaust gas. Such flame heater 100 not only has a heating function but provides a visual perception of exuberant vitality by looking at the flaming flame. The flame heater 100 also increases the atmosphere and decoration. According to the safety regulations, the overall height of the flame heater 100 is at least 200 cm above to avoid people being in danger of the flame from a top end of the glass tube 17.

Therefore, the kind of flame heater 100 has some drawbacks; for example, the height of the flame heater demanded over 200 cm to comply with the safety regulations but the height h1 of the flame F is only ½~⅔ height of the glass tube 17; such that there is no flame at an upper region h2 of the glass tube 17. With the reference to FIG. 1C, the heat f from the flame F is discharged through the upper outlet 171 of the glass tube 17, resulting in low temperature at the upper region h2 of the glass tube 17 and affecting the heating effect. Therefore, there is room for improvement.

SUMMARY OF THE INVENTION

It is a primary object of the present invention to provide a radiant heat lifting device for outdoor flame heater, which provides a heat-resistant net tube mounted on a top of a glass tube for accumulating the heat of a flame and producing infrared to increase the radiation thermal of the heater and thus enhance the effect of the outdoor heating.

In order to achieve the above object, the invention includes: a housing providing an inside space for installing a gas barrel; a base mounted on the housing and having a burner therein and a flame outlet at a top thereof; a plurality of support members standing straight on the housing and having a bottom end arranged at a periphery of the flame outlet; a frame body arranged at a top of the plurality of support members and having a mounted space between the pluralities of support members; a glass tube having a lower opening mounted on the flame outlet for positioning the glass tube in the mounted space between the pluralities of support members; wherein the glass tube has a section of heat-resistant net tube made of high-temperature resistant material and mounted on an upper opening thereof; the heat-resistant net tube includes countless meshes at a periphery thereof, a top outlet sealed and a bottom outlet connected to the upper opening of the glass tube; and a cover being a bowl-shaped, arranged on the heat-resistant net tube and including a multitude of circulation holes at a periphery thereof; whereby a flame emitted from the flame outlet along the glass tube up to the top outlet of the heat-resistant net tube by chimney effect to heat the heat-resistant net tube, and after accumulating the heat, the heat-resistant net tube produces infrared to increase the radiation thermal of the glass tube; an exhaust in the glass tube outflows from the meshes of the heat-resistant net tube to the circulation holes of the cover and discharges upward.

Base on the features disclosed, the preferred embodiment of the present invention comprises the heat-resistant net tube has a lid body sealed the top outlet thereof and an annular sleeve body mounted on the bottom outlet and the annular sleeve body has an inserted hole at a bottom edge thereof for inserting the upper opening of the glass tube and a plurality of elastic pieces at a periphery thereof for positioning the upper end of the glass tube.

Further, the cover includes a bottom surface locked at a top of the lid body by a plurality of bolts.

Further, the cover further includes a convex ring at a top periphery thereof and the convex ring is locked between a top end of the plurality of support members and a bottom surface of the frame body by a plurality of bolts.

Base on the features disclosed, the design of the present invention provides the combination of the heat-resistant net tube and cover to increase the radiation thermal of the heater, which solves the problem of previous heater being lack of high temperature on the top thereof, and thus enhance the effect of the outdoor heating. Moreover, there is not any baffle plates between the heat-resistant net tube and glass tube to block the infrared of heat-resistant net tube.

DETAILED DESCRIPTION OF THE PREFERRED EMBODIMENT

Figure 1A:
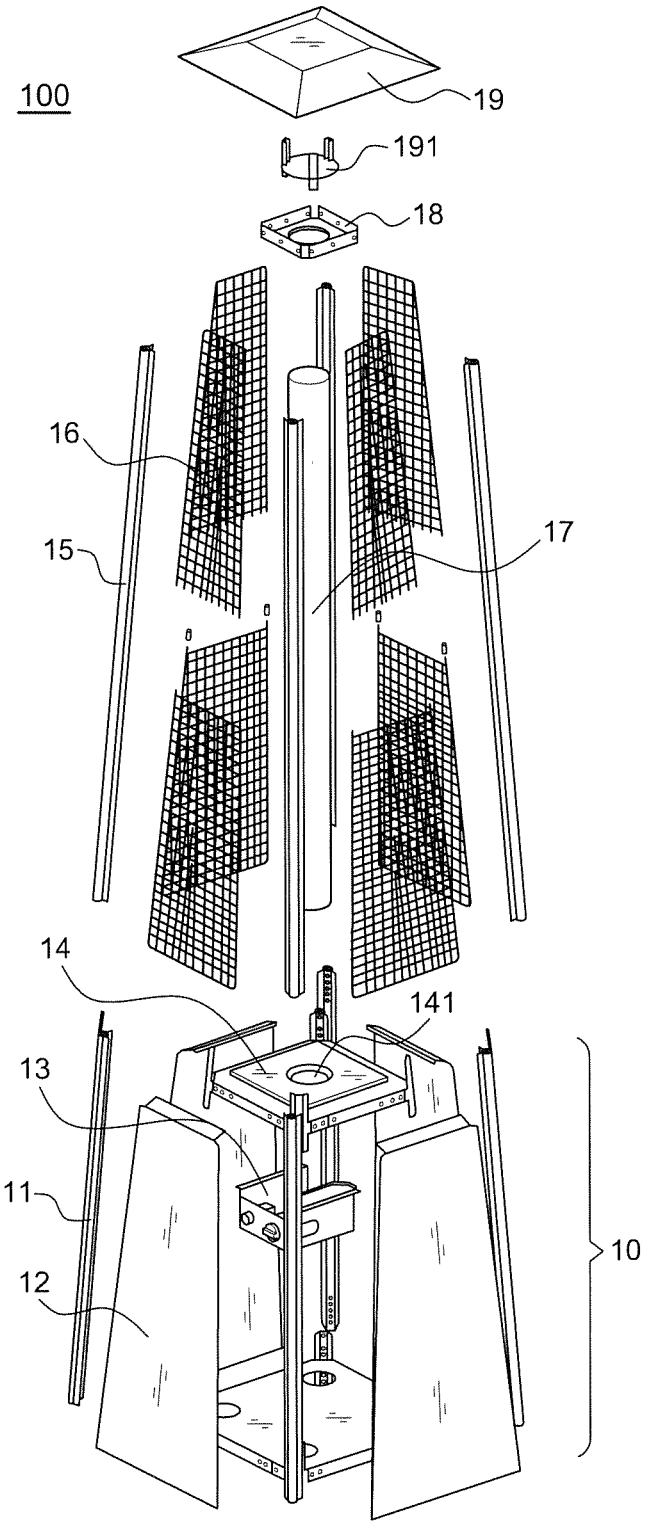
FIG.1A PRIOR ART
FIGS. 1A, 1B, and 1C are schematic views of conventional outdoor flame heater.
Figure 1B:
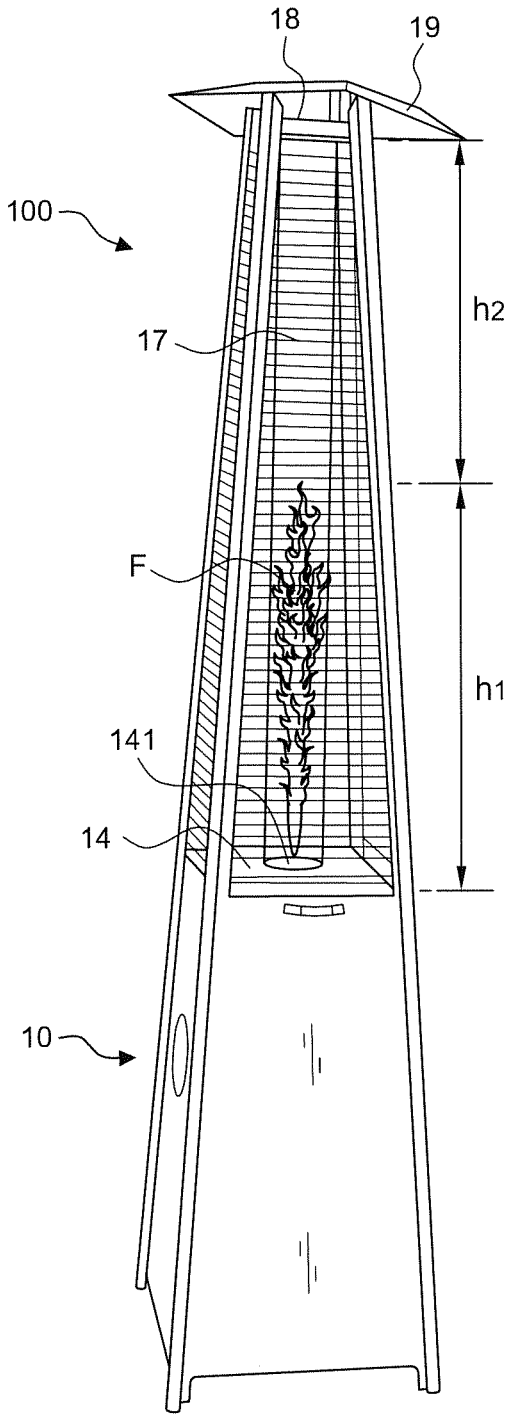
FIG.1B PRIOR ART
Figure 1C:
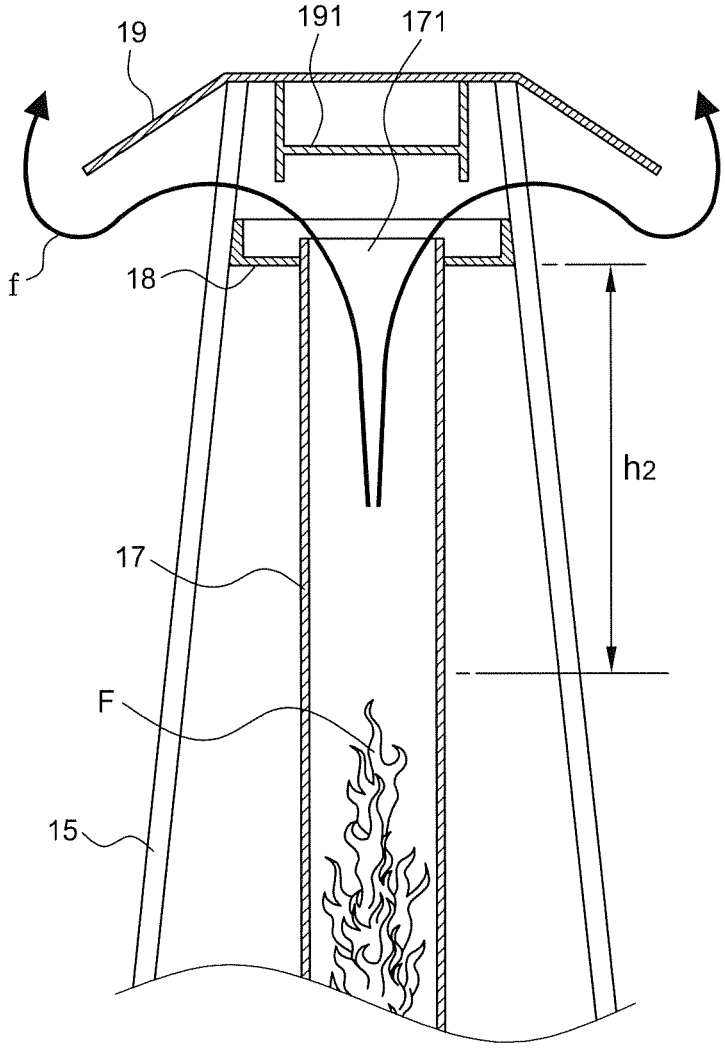
FIG.1C PRIOR ART
Figure 2:
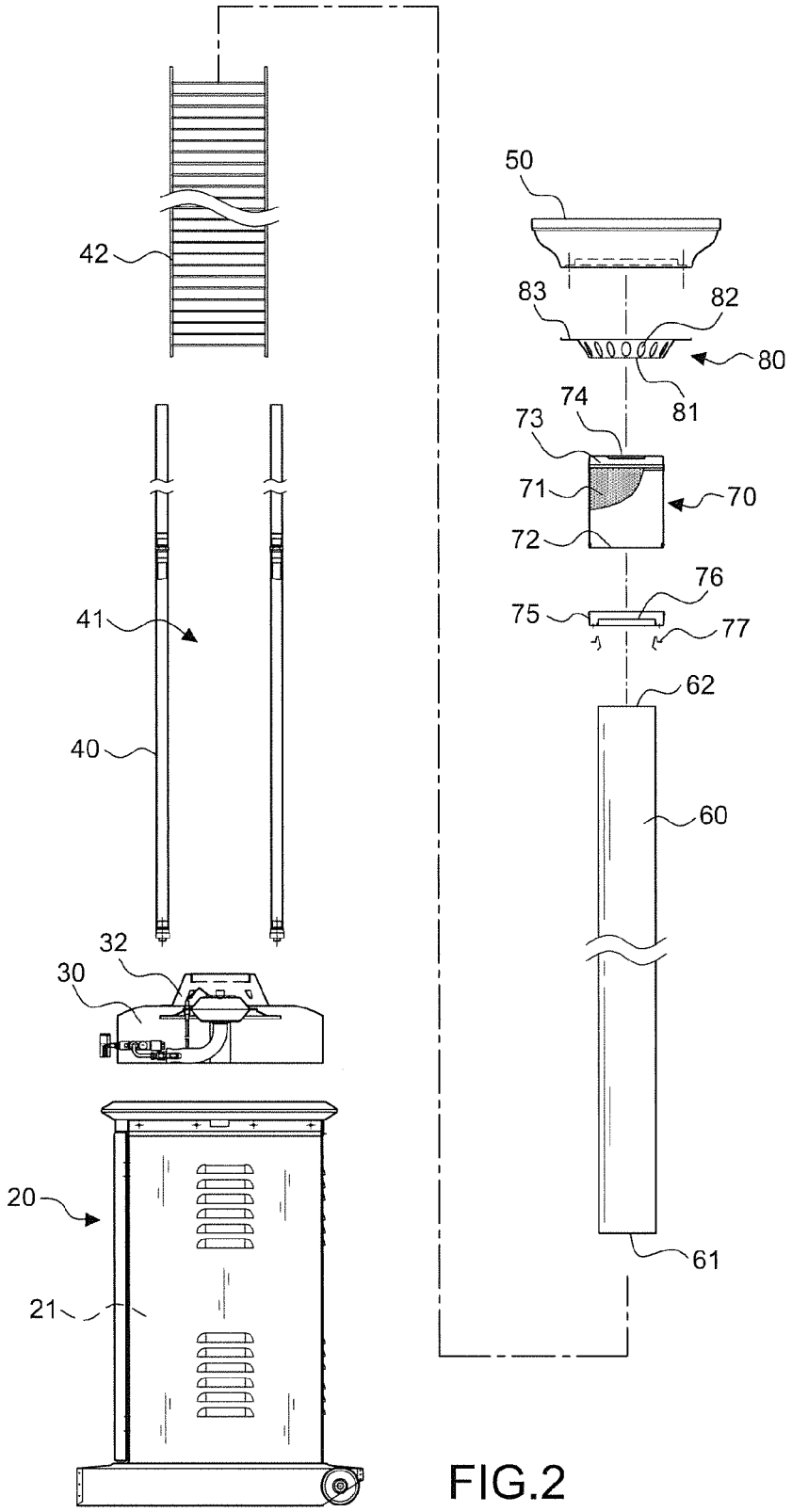
FIG. 2 is an exploded schematic view of the present invention.
Figure 3:
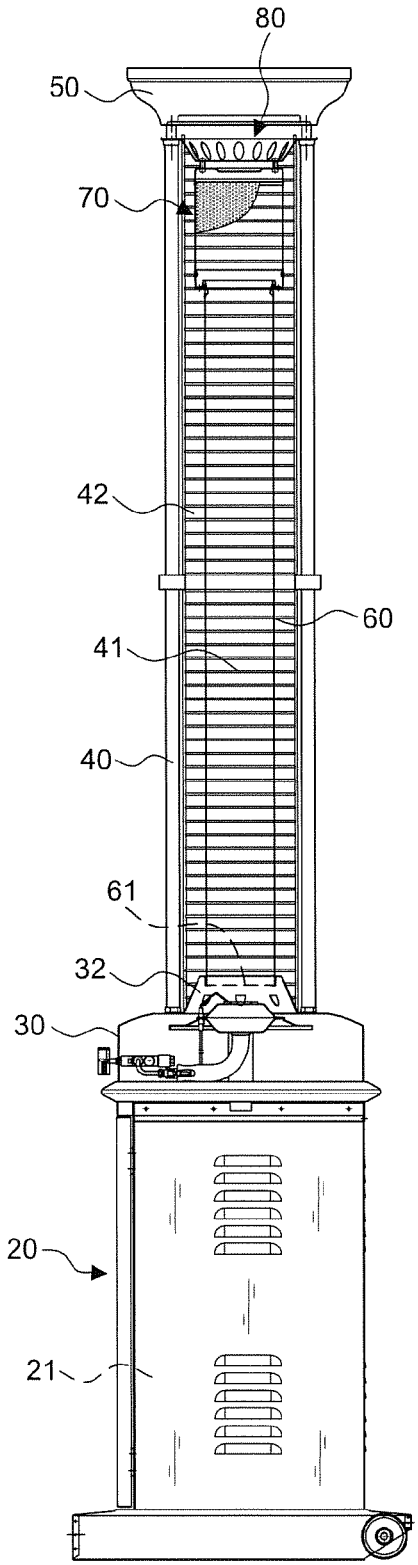
FIG. 3 is a schematic view of the present invention in a fully assembled state.

Referring to FIGS. 2 through 5, the preferred embodiment of a radiant heat lifting device for outdoor flame heater in accordance with the present invention comprises a housing 20 providing an inside space 21 for installing a gas barrel; a base 30 mounted on the housing 20 and having a burner 31 therein and a flame outlet 32 at a top thereof; a plurality of support members 40 standing straight on the housing 20 and having a bottom end arranged at a periphery of the flame outlet 32; a frame body 50 arranged at a top of the plurality of support members 40 and having a mounted space 41 between the pluralities of support members 40; a glass tube 60 having a lower opening 61 mounted on the flame outlet 32 for positioning the glass tube 60 in the mounted space 41 between the pluralities of support members 40. The glass tube 60 is made of quartz glass having a high-temperature resistant effect. In this embodiment, the present invention further comprises several pieces of protective wire mesh 42 fixing between the pluralities of support members 40 to avoid contacting with the high-temperature glass tube 60. However, the above-mentioned structure is a prior art and thus will not be described in details here.

Figure 4:
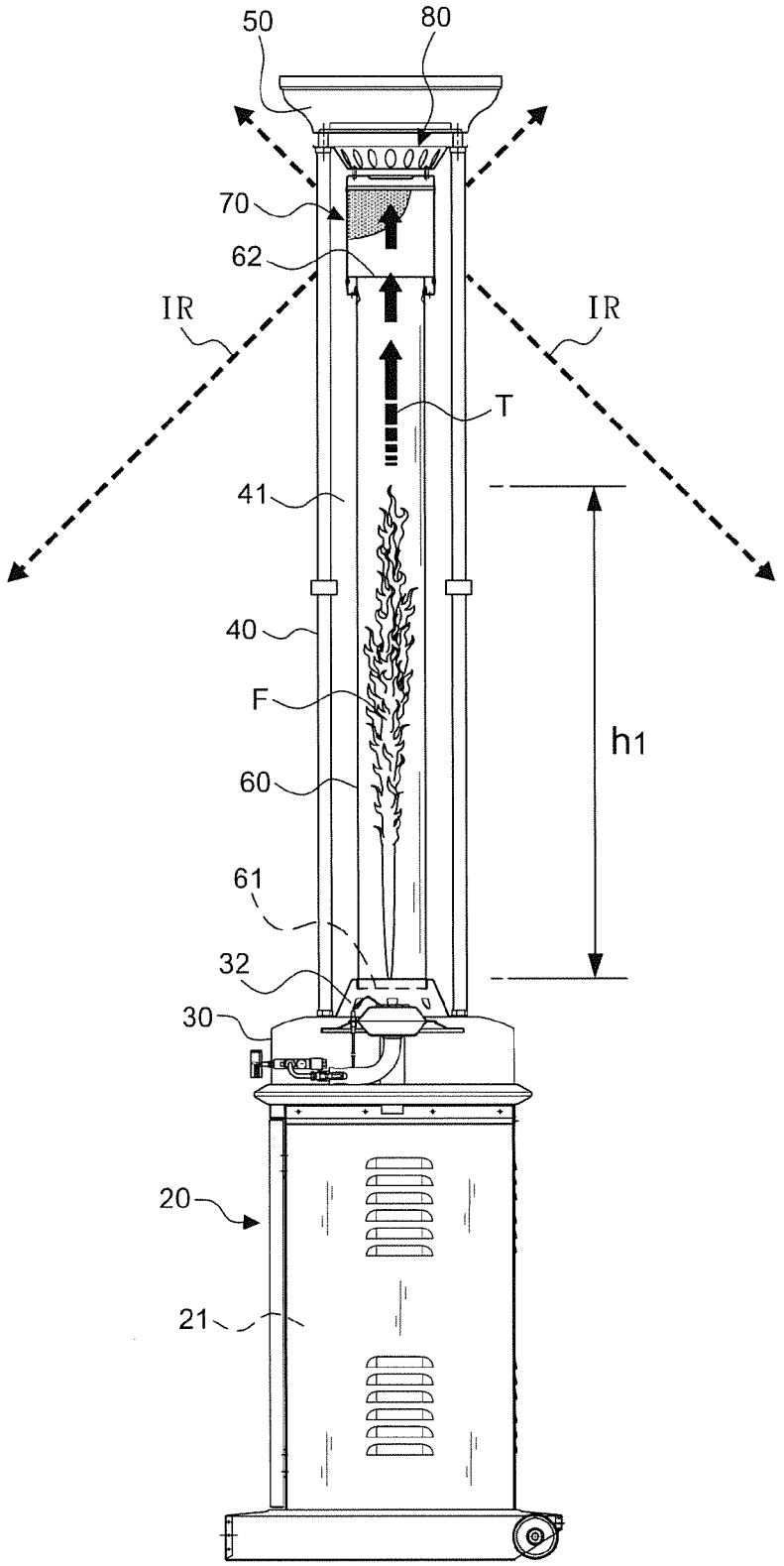
FIG. 4 is an application example view of the present invention.
Figure 5:
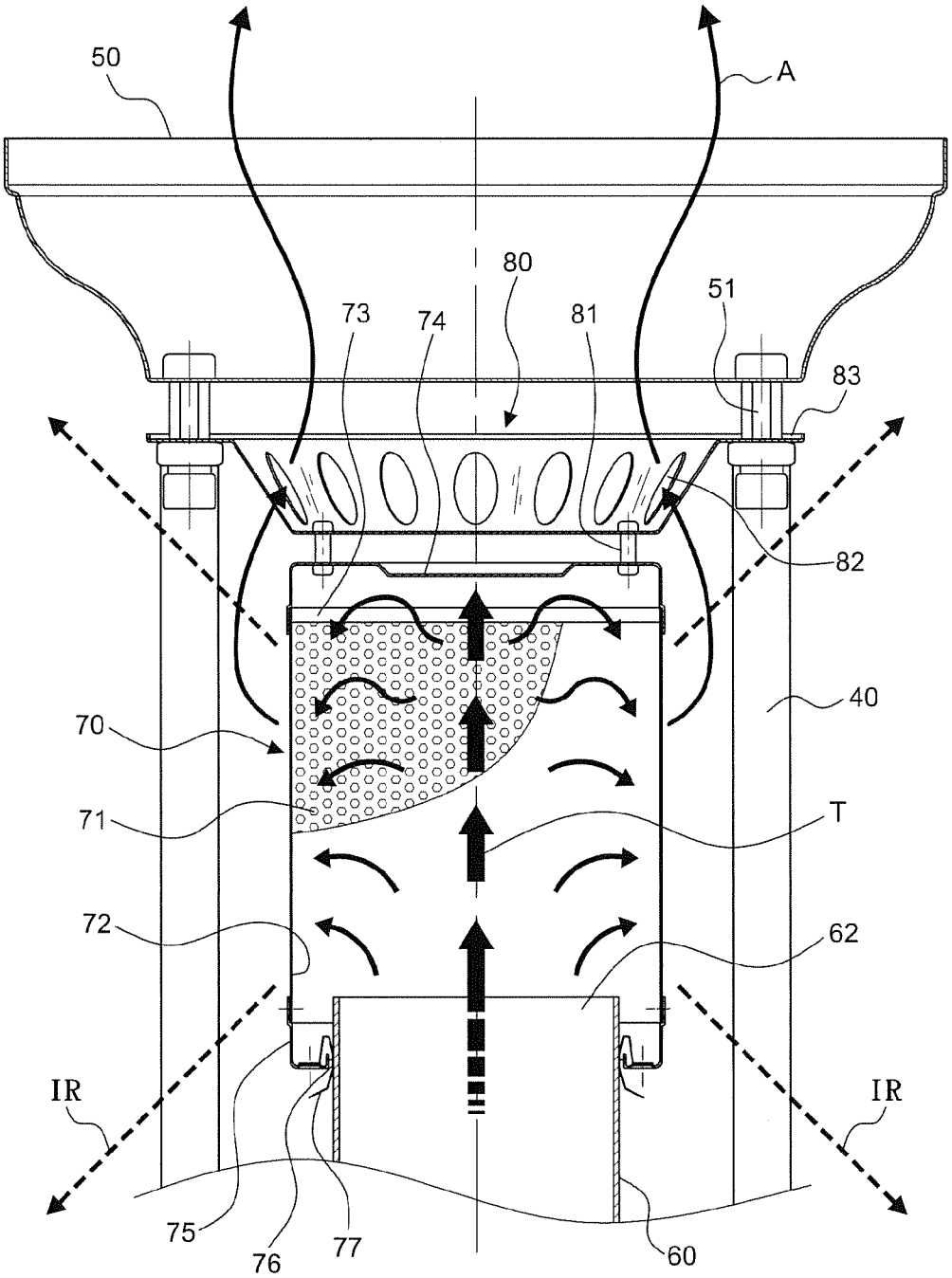
FIG. 5 is a sectional view of the main structures of the present invention.

Referring to FIGS. 4 and 5, the present invention is characterized in that the glass tube 60 has a section of heat-resistant net tube 70 made of high-temperature resistant material and mounted on an upper opening 62 thereof; the heat-resistant net tube 70 includes countless meshes 71 at a periphery thereof, a top outlet 73 sealed and a bottom outlet 72 connected to the upper opening 62 of the glass tube 60. In this embodiment, the heat-resistant net tube 70 is made of a high-temperature resistant metal of the stamping forming or a heat-resistant ceramic. the heat-resistant net tube 70 has a lid body 74 sealed the top outlet 73 thereof and an annular sleeve body 75 mounted on the bottom outlet 72 and the annular sleeve body 75 has an inserted hole 76 at a bottom edge thereof for inserting the upper opening 62 of the glass tube 60 and a plurality of elastic pieces 77 at a periphery thereof for positioning the upper end of the glass tube 60.

A cover 80 being a bowl-shaped arranged on the heat-resistant net tube 70 and including a multitude of circulation holes 82 at a periphery thereof. The cover 80 includes a bottom surface locked at a top of the lid body 74 by a plurality of bolts 81. The cover 80 further includes a convex ring 83 at a top periphery thereof and the convex ring 83 is locked between a top end of the plurality of support members 40 and a bottom surface of the frame body 50 by a plurality of bolts 51.

Whereby a flame emitted from the flame outlet 32 along the glass tube 60 up to the top outlet 73 of the heat-resistant net tube 70 by chimney effect to heat the heat-resistant net tube 70, and after accumulating the heat, the heat-resistant net tube 70 produces infrared IR to increase the radiation thermal of the glass tube 60; an exhaust A in the glass tube 60 outflows from the meshes 71 of the heat-resistant net tube 70 to the circulation holes 82 of the cover 80 and discharges upward.

Base on the features disclosed, the flame F reaches to a certain height h1 as shown in FIG. 4, and a high temperature T of an outer flame of the flame F extends through the heat-resistant net tube 70 to the sealed lid body 74 as shown in FIG. 5, in order to accumulate the heat so that the heat-resistant net tube 70 produces the infrared IR to increase the radiation thermal of the glass tube 60. On the contrary, if the high temperature T of the flame F is discharged without the sealed lid body 74 on the top of the heat-resistant net tube 70, the heat-resistant net tube 70 may not accumulate the heat and produce the infrared IR. Therefore, the design of the present invention provides the combination of the heat-resistant net tube 70 and cover 80 to increase the radiation thermal of the heater, which solves the problem of previous heater being lack of high temperature on the top thereof, and thus enhance the effect of the outdoor heating. Moreover, there is not any baffle plates between the heat-resistant net tube 70 and glass tube 60 to block the infrared of heat-resistant net tube 70.

What is claimed is:

1. A radiant heat lifting device for outdoor flame heater, comprising:

a housing defining an inside space for installing a gas barrel;

a base mounted on the housing and having a burner therein and a flame outlet at a top thereof;

a plurality of support members disposed on the housing and having a bottom end arranged at a periphery of the flame outlet;

a frame body arranged at a top of the plurality of support members, a mounted space being formed between the support members;

a glass tube having a lower opening at a first end thereof mounted on the flame outlet for positioning the glass tube in the mounted space between the support members;

a heat-resistant net tube made of high-temperature resistant material and mounted to extend longitudinally upward from an upper opening of the glass tube; the heat-resistant net tube including an intermediate portion having a plurality of mesh openings formed therethrough, the heat-resistant net tube having a top end sealed and a bottom outlet connected to the upper opening of the glass tube; and a cover arranged on the heat-resistant net tube to be longitudinally displaced from the intermediate portion thereof, the cover including a multitude of circulation holes at a periphery thereof;

whereby a flame emitted from the flame outlet along the glass tube heats the heat-resistant net tube to thereby increase the thermal radiation of the glass tube; and an exhaust in the glass tube flows out through the mesh openings of the heat-resistant net tube to be discharged through the circulation holes of the cover.

2. The radiant heat lifting device for outdoor flame heater as recited in claim 1, wherein a lid body seals the top end of the heat-resistant net tube, and an annular sleeve body is mounted on the bottom outlet of the heat-resistant net tube, and an inserted hole extending through a bottom edge of the annular sleeve body for receiving the upper opening of the glass tube and a plurality of elastic pieces are mounted at a periphery of the inserted hole for positioning an opposing second end of the glass tube.

3. The radiant heat lifting device for outdoor flame heater as recited in claim 2, wherein a bottom surface of the cover is locked to a top of the lid body by a plurality of bolts.

4. The radiant heat lifting device for outdoor flame heater as recited in claim 3, further comprising a convex ring at a top periphery of the cover, wherein the convex ring is locked between a top end of the plurality of support members and a bottom surface of the frame body by a plurality of bolts.

5. The radiant heat lifting device for outdoor flame heater as recited in claim 1, wherein the glass tube is made of quartz glass.

6. The radiant heat lifting device for outdoor flame heater as recited in claim 1, wherein the heat-resistant net tube is made of a high-temperature resistant metal of the stamping forming or a heat-resistant ceramic.

7. The radiant heat lifting device for outdoor flame heater as recited in claim 1, further comprising a plurality of protective wire mesh pieces being fixed between the support members.

8. The radiant heat lifting device for outdoor flame heater as recited in claim 1, wherein the cover is bowl-shaped.

* * * * *